US005792006A

United States Patent [19]

Hesser

[11] Patent Number: 5,792,006

[45] Date of Patent: Aug. 11, 1998

[54] AXIALLY COLLAPSIBLE GOLF CLUBS AND GOLF CLUB SHAFTS

[75] Inventor: Robert T. Hesser, Park Ridge, Ill.

[73] Assignee: Full Swing Custom Clubs, Inc. Park Ridge, Ill.

[21] Appl. No.: 795,083

[22] Filed: Feb. 5, 1997

[51] Int. Cl.[6] ..... A63B 52/16

[52] U.S. Cl. ..... 473/239; 473/296

[58] Field of Search ..... 473/239, 316, 473/273, 296, 48; 15/144.4; 135/75

[56] References Cited

U.S. PATENT DOCUMENTS

| | | | |
|---|---|---|---|
| 2,022,108 | 5/1935 | Child | 473/239 |
| 3,829,092 | 8/1974 | Arkin | 473/239 |

*Primary Examiner*—Sebastiano Passaniti
*Assistant Examiner*—Stephen L. Blau
*Attorney, Agent, or Firm*—Charles F. Lind

[57] ABSTRACT

The disclosed collapsible golf club shaft is formed of a conventional stepped one-piece tubular golf shaft having diameters progressing from a large ID and OD end to a smaller ID and OD end, being cut in two at the end of one cylindrical axial sections next to the larger axial section, allowing the two pieces to be telescoped together as inner and outer pieces, and shifted then between a collapsed position compactly nested together and an extended operative position with only endmost stepped sections of the pieces yet overlapped at a separable connection between the pieces. A screw can be extended through wall structure openings and threaded into a reinforcing structure inside the inner piece at the connection for locking the pieces together in the extended operative position. A golf club formed from this shaft, with a hand grip on the outer piece and a head on the inner piece, at the opposite ends of the extended shaft, can be collapsible to slightly more than half the length of the extended operative club, for compact storage and handling.

16 Claims, 1 Drawing Sheet

FIG.1
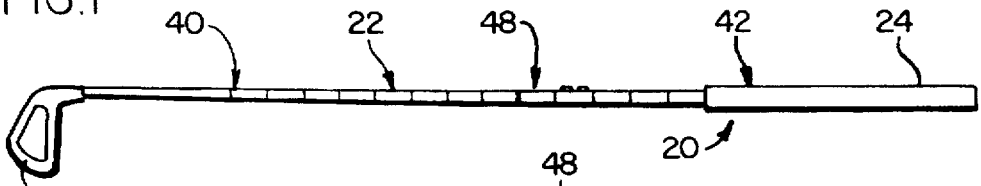
FIG.2
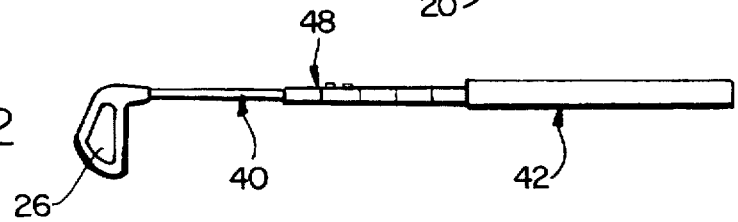
FIG.3
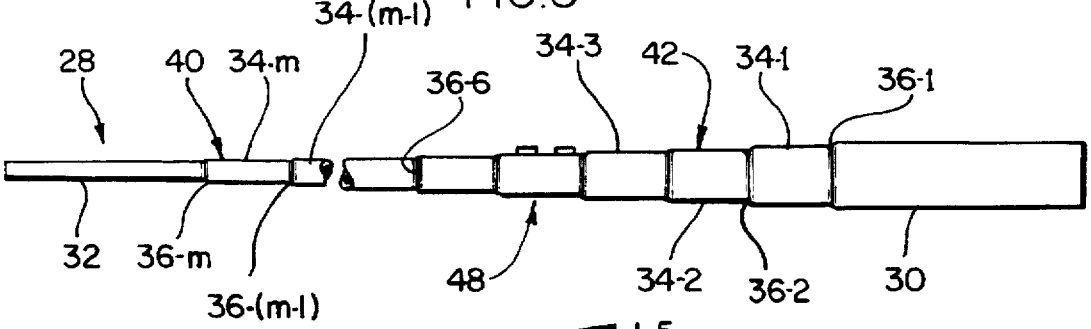
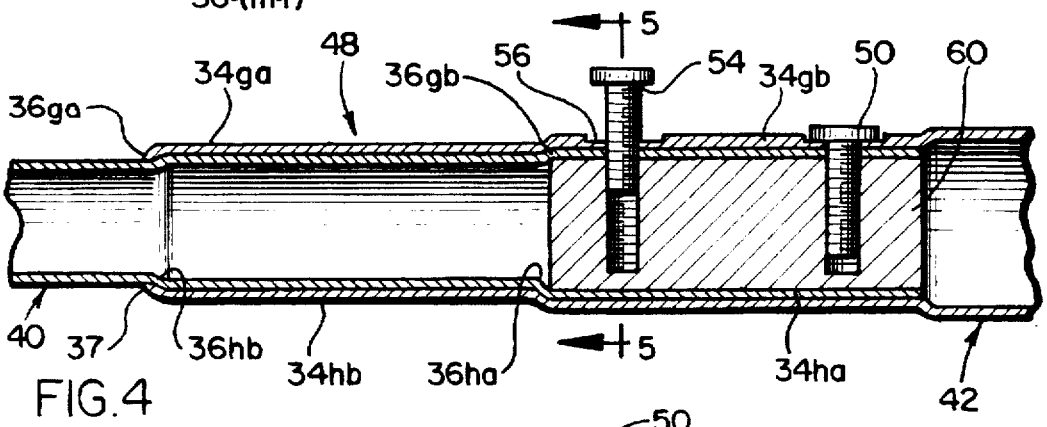
FIG.4
FIG.5
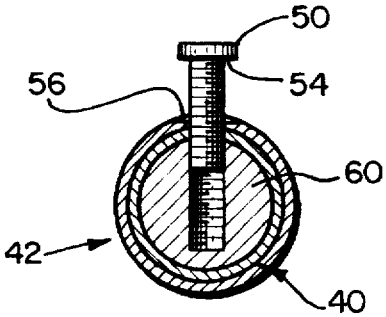

AXIALLY COLLAPSIBLE GOLF CLUBS AND GOLF CLUB SHAFTS

BACKGROUND OF THE INVENTION

Millions participate in the sport of golf, and some even travel to famed courses or pleasant weather regions so as to enlarge the golfing experience and enjoyment such brings. A problem associated with nomadic golf is the transportation of one's clubs, due in part to the weight of a complete set of clubs and holding bag, but also to the awkward sizing of this package. Specifically, most golf clubs have a length exceeding forty inches, and some of the newer and very popular power clubs might have a length exceeding forty five inches. While airlines transport golf clubs as part of one's luggage, appropriate travel bags are needed, adding again to the package size and weight, and costs for owning or renting the travel bag and any surcharge for its shipment.

What is particularly frustrating is the great difficulty posed in attempting to smuggle even a single club or several selected irons and/or woods into one's luggage, as the club length exceeded even the maximum diagonal inside of one's suitcases and travel bags, except possibly for an unfolded garment bag.

Some golf clubs are available now that have shafts that can be broken down or taken apart at a threaded joint, but such have not been well received for several reasons. Thus, such clubs have not conformed to rules established by the U.S. Golf Association and have not received its certification for tournament use. Also, the functional characteristics of the clubs, including the "feel" or weight, swing-weight and stiffness have lacked consistency compared to one-piece shafts. Further, with any degree of club head looseness or wobble, plus the knowledge that the torquing forces occasioned every time a golf ball was hit with the off-set striking club head/face could loosen the connection, could have lead many to conclude such clubs might be unsafe.

SUMMARY OF THE INVENTION

This invention relates to and an object of this invention is to provide an improved golf club, or club shaft, that can be broken down or collapsed for reducing the club length to a manageable size, for convenient nonuse transportation, or the like.

A more specific object of this invention is to provide an improved golf club shaft of two sections suited to be telescoped one within the other and be shifted between extended and collapsed positions, where in the extended position adjacent stepped sections can be overlapped and locked together at a connection sufficiently strong and rigid to act and feel functionally as a one-piece shaft, substantially maintaining the overall weight, swing-weight and stiffness, and withstanding torquing forces without excessive shaft shifting and/or twisting.

Another significant object of this invention is to provide an improved collapsible golf club and/or shaft construction that conforms to the rules and regulations of the U.S. Golf Association for tournament use.

BRIEF DESCRIPTION OF THE DRAWINGS

These and other objects, features or advantages of the invention will be more fully understood and appreciated after reviewing the following specification which includes as a part thereof the accompanying drawings, wherein:

FIG. 1 is a side elevational view of a collapsible golf club (a mid-iron) incorporating the subject invention, and extended to its operative length;

FIG. 2 is a side elevational view of the golf club of FIG. 1, except collapsed to any inoperative storage length;

FIG. 3 is a side elevational view, to an enlarged scale, of the shaft forming the golf club of FIG. 1, shown in its extended position but without a head or hand grip thereon;

FIG. 4 is a sectional view, to an enlarged scale even compared to FIG. 3, of the separable connection utilized in the collapsible club/shaft shown in the previous figures, shown in its extended position but with some components missing for clarity of disclosure; and FIG. 5 is a sectional view as seen generally from line 5—5 in FIG. 4.

DETAILED DESCRIPTION OF THE INVENTION

In order to clarify the disclosure and its needs, FIG. 1 illustrates golf club 20 having on elongated shaft 22 with a hand grip 24 and a head 26 operatively provided adjacent opposite ends of the shaft. The head 26 typically will have a ball contacting region laterally off-set from the longitudinal axis of shaft.

The club illustrated is a mid-iron, intended for hitting golf balls moderate distances, and has a moderate shaft length compared to other clubs in a matching set. Thus, other irons in the set respectively intended for hitting longer distance shots would have longer shaft or those intended for hitting shorter distance shots would have shorter shafts, the shaft length difference being of the order of perhaps 0.5 inch for each consecutive longer or shorter distance club, down to a nine iron where the pitching and any sand wedges might be of the same length. Woods are generally intended for hitting longer shots, and would typically have shafts longer but possibly leaner than the irons. By way of example, a driver might have a shaft length of 43 inches, a two iron might have a shaft length of 39 inches, and a nine iron might have a shaft length of 35.5 inches.

Nonetheless, golf club design is intended to provide the same "swing-weight" and "feel" when swinging any club, regardless of the club being a wood or an iron or of its shaft length. To provide this, the club head on shorter length clubs, on average, will weigh more than the club head of long shot clubs. Also, a shaft has somewhat stiff elongated end portions inwardly from the opposite grip and head ends, and has a less stiff region therebetween known as the "kick" or "flex" point, which is typically near the middle of the shaft.

In a matched set of clubs (irons for example), all shafts would start out the same, as a single tubular piece shaft 28 (see FIG. 3) longer than needed, and the club manufacturer would cut them to the respective lengths needed for making the differently sized clubs. To allow for these cuts, the opposite shaft ends might be of substantially uniform outer diameter (ODs) over extended lengths, the grip end 30 being of a length sufficient to accommodate the hand grip 24 (and the golfer's hands in gripping the club), and the head end 32 being of a length sufficient after being cut for making its connection to the hosel of the club head 26. Shaft manufacturer's specifications would specify the shaft locations for cutting each of the different shaft lengths needed for the clubs.

A conventional golf shaft 28 converges from a large OD at the grip end 30 to a smaller OD at the head end 32 (for example, from approximately 0.620 inch OD to approximately 0.294 inch OD. However, most alloy steel shafts do not taper uniformly, but between the opposite extended grip and head ends 30 and 32 respectively have possibly between ten and twenty shorter axial sections 34-1, 34-2, 34-3, etc., to 34-(n−1) and 34-n. Each axial section is substantially cylindrical, and adjacent segments are stepped down in size and connected together and to the opposite elongated shaft ends by radial wall portions 36-1, 36-2, etc., to 36-n and 36-(n+1). The wall thickness of the tubular shaft likewise will vary, being thin at the large OD hand grip end 30 and being thicker at the small OD head end 32. The lengths and number of stepped sections, and ODs and IDs will vary depending on the shaft design and/or manufacturer.

Shaft constructions must provide sufficient stiffness and stability to resist club whipping and head wobbling during the golf swing, at the grip end of highest torquing forces and at the head end of highest speeds and actual impacts forces.

The invention is particularly applicable to alloy steel shafts, with thin tubular shaft walls of stepped OD and ID sections along the shaft lengths, preferably where the stepped sections are of substantially the same axial lengths.

The inventive club shaft 22 has two separate pieces formed from a conventional stepped one-piece shaft 28, by cutting it in two at an appropriate location at the end of one of the cylindrical axial sections, just before the radial wall step to the next larger axial section. This will define a smaller OD or head piece 40 and a larger OD or grip piece 42. The cut further should be made beyond the approximate mid-way "kick" or "flex" point of the shaft, as measured from the head end of the club, meaning that the head piece 40 will be longer than the grip piece 42.

The one-piece shaft 28 will be sized so that the ODs of all but the two endmost sections 34*ha*, 34*hb* of the head piece 40 will be smaller than the smallest ID of the grip piece 42, such that the head piece can be telescoped almost completely through the grip piece, with the stepped sections all converging in the same direction, to expose the head end 32 beyond the small OD end of the grip piece. The smallest ID of the grip piece 42 will typically be the inner edge 37 of the radial wall 36*ga* made at the general location of the shaft cut, being the step from the smallest axial section 34*ga* of the grip piece. Further, the ODs of the two endmost sections 34*ha* and 34*hb* of the head piece 42 will be substantially the same as the IDs of the smallest two endmost sections 34*ga* and 34*gb* of the grip piece 40, such that a telescoped fit thereof will be snug. The fully extended position of the head piece 40 from the grip piece 42 is specifically determined in this snug telescoped fit and when the radial portions 36*ga* and 36*hb*, and 36*gb* and 36*ha* respectively between the overlapped sections of the shaft pieces butt one another.

The overlapped endmost sections 34*ga* and 34*hb*, and 34*gb* and 34*ha*, respectively on the separate shaft pieces define a separable connection 48 suited for holding the pieces 40 and 42 in the extended position. The connection is effective in part because of the snug telescoped fit of the overlapped sections with one another. Also, two cap screws 50 are fitted though respective openings drilled in the grip and head pieces in the region of the larger and endmost overlapped sections of the connection 48. Each screw 50 might preferably have a head with an annular flat underface 54 that is snugged, when tightened down, against the grip piece OD. A segmental flat 56 across the grip piece OD at each screw opening and normal to the axis of the screw, will allow the flat underface 54 of the screw head to fit flush thereagainst for aggressively keying the separate shaft pieces against allowable twisting movements relative to one another, when the screw is tightened. The flats 56 can be formed by swaging or grinding the OD. It is preferred that the screws 50 have a socket opening for insertion of a conventional hex wrench tool, to provide reliable keyed fit therebetween for tightening and loosening the screws. Of great importance also, a solid plug 60 of a lightweight, hard and durable material is fitted snugly into and secured as by adhesive relative to the largest ID section 34*ha* of the head piece 40, forming an unyielding interior in the otherwise hollow tubular head piece and also providing material the screws 50 will be threaded into for added durability and reliability during repeated extending and collapsing of the shaft. A rod formed of aluminum, hard plastic, or a woven fiber based phenolic laminate marketed under the trademark GAROLITE LE would prove effective when cut to length for making the plug 60.

The assembly and above fabrication of the composite two-piece shaft is completed before the hand grip 24 or head 26 is secured relative to the shaft 22, as once either is secured to its respective shaft piece, the separate shaft pieces 40 and 42 will not be able to be assemblied or telescoped together. However, once assembled and with either the hand grip 24 or head 26 secured relative to the shaft 22, the shaft pieces 40 and 42 will become interfitted and cannot be separated. On the other hand, release of the connection 48 will allow the head piece 40 to be more completely nested within the grip piece 42 and defining a much shorter collapsed club position (see FIG. 3), where either the larger end of the head piece butts against the hand grip 24 secured on the grip piece, or the head 26 hits the smaller end of the grip piece.

By way of example, TRUE TEMPER "Lite" golf shafts have been found well suited to make effective collapsible shaft pieces according to this invention, having in excess of ten stepped sections each of the same axial length (almost one and one-half inches long) between the elongated hand grip end 30 and head end 32. In utilizing this one-piece shaft, the shaft cut might specifically be made just beyond the sixth radial step 36-6 from the larger hand grip end 30 for making shafts suitable for irons, and just beyond the eighth radial step (not numbered) from the hand grip end for making shafts for woods. With cuts at these location, the two endmost sections are of a snug fit when telescoped, dictated by the IDs of the grip piece two endmost sections being substantially the same as the ODs of the head piece two endmost sections. The separable connection 48 comprised of the overlapped endmost sections of the separate head and grip pieces is axially extended almost three inches, for sound shaft stability, and the head end of the separable connection is just beyond the half-way point or approximate "kick" point of the extended shaft which thus will be in the head piece 24.

Of interest also, a typical nine iron made in this manner is reduced from about thirty seven inches overall length when extended to about twenty three inches overall when collapsed; while a typical power driver is reduced from about forty five inches overall length when extended to less than twenty seven inches overall when collapsed.

As the connection screws 50 basically represent the only visible difference between the collapsible clubs of this invention and one-piece shaft clubs, for psychological purposes only, it might be desirable to assemble the club head 24 on the extended shaft in the orientation that will locate the screws on the underside of the shaft when a golfer is actually addressing a golf ball and making a golf swing, so that out-of-sight, out-of-mind frees the golfer of the thought that the club is collapsible!

While a specific embodiment has been illustrated, minor changes could be made therefrom without departing from the spirit of the invention. Thus, only one endmost section of each piece might be overlapped, or only one screw might be used, or lock washers might be used with the screw(s). However, while these might work, such variations might also sacrifice the overall excellence of the structure as disclosed. The invention therefore is to be determined only by the scope of the following claims.

What is claimed is:

1. A collapsible golf club shaft formed of two elongated tubular pieces each having a wall structure of stepped sections of different diameters each progressing from a large ID and OD end to a smaller ID and OD end, the pieces being sized to be telescoped together as inner and outer pieces and be shifted while telescoped between a collapsed position with the inner piece compactly nesting within the outer piece and an extended position with all sections exposed except for endmost sections of the pieces that are yet telescoped, but now snugly telescoped together for defining in part a separable connection holding the club pieces in the extended position, and said separable connection further being comprised with reinforcing structure secured in the inner piece where overlapped by the outer piece at the connection, and a screw extended through aligned openings in the wall structures of the overlapped sections at the connection and threaded into the reinforcing structure.

2. A collapsible golf club shaft according to claim 1, further comprising a flat face segmentally formed across the OD of the outer piece wall structure and across the opening and normal to the axis of the screw to fit therethrough, and the screw having a head with a flat underside that cooperates flush against the flat face for effectively keying the pieces against allowable twisting movements relative to one another when the screw is tightened.

3. A collapsible golf club shaft according to claim 2, further comprising the screw having a socket opening for insertion of a conventional hex wrench tool.

4. A collapsible golf club shaft according to claim 3, further comprising the reinforcing structure being a solid plug of a lightweight, hard and durable material fitted snugly into and secured as by adhesive relative to the inner piece.

5. A collapsible golf club shaft according to claim 4, further comprising the solid plug material being any of aluminum, hard plastic, or a woven fiber based phenolic laminate marketed under the trademark GAROLITE LE.

6. A collapsible golf club made with the shaft of claim 5, further comprising a club head operatively secured to the inner piece at its smaller exposed OD end and a club grip operatively secured to the outer piece at its largest OD end.

7. A collapsible golf club made with the shaft of claim 2, further comprising a club head operatively secured to the inner piece at its smaller exposed OD end and a club grip operatively secured to the outer piece at its largest OD end.

8. A collapsible golf club made with the shaft of claim 3, further comprising a club head operatively secured to the inner piece at its smaller exposed OD end and a club grip operatively secured to the outer piece at its largest OD end.

9. A collapsible golf club shaft according to claim 4, further comprising the shaft pieces being formed by cutting a one-piece shaft in two, slightly closer to the larger OD end thereof and adjacent a radial portion between adjacent sections, whereby the radial portion remains on the outer piece and defines the smaller OD end thereof, effective to be butted by a radial portion on the inner piece when the pieces are overlapped and telescoped to define the extended position of the shaft.

10. A collapsible golf club shaft according to claim 9, further comprising the connection being formed of two endmost sections of the pieces that remain telescoped in the extended position of the shaft, with radial portions therebetween operable to butt in the extended position of the shaft.

11. A collapsible golf club made with the shaft of claim 10, further comprising a club head operatively secured to the inner piece at its smaller exposed OD end and a club grip operatively secured to the outer piece at its largest OD end.

12. A collapsible golf club shaft according to claim 6, further comprising the connection being formed with two axially separated screws extended through aligned openings in the wall structures of the overlapped sections at the connection and threaded into the reinforcing structure.

13. A collapsible golf club made with the shaft of claim 12, further comprising a club head operatively secured to the inner piece at its smaller exposed OD end and a club grip operatively secured to the outer piece at its largest OD end.

14. A collapsible golf club made with the shaft of claim 9, further comprising a club head operatively secured to the inner piece at its smaller exposed OD end and a club grip operatively secured to the outer piece at its largest OD end.

15. A collapsible golf club made with the shaft of claim 4, further comprising a club head operatively secured to the inner piece at its smaller exposed OD end and a club grip operatively secured to the outer piece at its largest OD end.

16. A collapsible golf club made with the shaft of claim 1, further comprising a club head operatively secured to the inner piece at its smaller exposed OD end and a club grip operatively secured to the outer piece at its largest OD end.

* * * * *